US010486163B2

(12) United States Patent
Pallmann et al.

(10) Patent No.: US 10,486,163 B2
(45) Date of Patent: Nov. 26, 2019

(54) COMMINUTING UNIT FOR A COMMINUTING DEVICE FOR COMMINUTING FEED MATERIAL, IN PARTICULAR KNIFE BASKET

(71) Applicant: PALLMANN MASCHINENFABRIK GmbH & Co. KG, Zweibruecken (DE)

(72) Inventors: Hartmut Pallmann, Zweibruecken (DE); Volker Degel, Blieskastel-Niederwuerzbach (DE)

(73) Assignee: PALLMANN MASCHINENFABRIK GmbH & Co. KG, Zweibruecken (DE)

( * ) Notice: Subject to any disclaimer, the term of this patent is extended or adjusted under 35 U.S.C. 154(b) by 565 days.

(21) Appl. No.: 15/149,755

(22) Filed: May 9, 2016

(65) Prior Publication Data

US 2016/0325462 A1 Nov. 10, 2016

(30) Foreign Application Priority Data

May 9, 2015 (DE) ..... 10 2015 005 787

(51) Int. Cl.
*B02C 18/18* (2006.01)
*B27L 11/00* (2006.01)

(52) U.S. Cl.
CPC ..... *B02C 18/18* (2013.01); *B02C 18/186* (2013.01); *B27L 11/005* (2013.01)

(58) Field of Classification Search
CPC ..... B02C 18/00; B02C 18/06; B02C 18/083; B02C 18/143; B02C 18/18; B02C 18/182; B02C 18/186
USPC ..... 241/92, 278.1, 294, 298
See application file for complete search history.

(56) References Cited

U.S. PATENT DOCUMENTS 4,887,772 A * 12/1989 Robinson ..... B27L 11/005 241/92
5,485,873 A 1/1996 Crammond
5,660,218 A * 8/1997 Jonkka ..... B27L 11/005 144/176

(Continued)

FOREIGN PATENT DOCUMENTS

DE 695 01 961 T2 7/1998
DE 101 25 922 A1 11/2002

(Continued)

*Primary Examiner* — Shelley M Self
*Assistant Examiner* — Jared O Brown
(74) *Attorney, Agent, or Firm* — Muncy, Geissler, Olds & Lowe, P.C.

(57) ABSTRACT

A comminuting unit for a comminuting device for comminuting feed material, in particular a knife basket, with a plurality of rod-shaped blade supports concentrically arranged about an axis, which at their ends are each rigidly connected with a support ring or supporting disc that are concentric to the axis. At least one of the blade supports has a receptacle for securing a knife assembly having a chipping blade, wherein the blades of all chipping blades have a common radial distance from the axis. Between the blade support and the knife assembly at least one adjusting device is provided, with which the radial distance is adjustable. The receptacle has a receiving strip and a clamping strip, which are mounted in axially parallel position detachably on the blade support, the knife assembly being tensioned against the receiving strip via the clamping strip.

14 Claims, 4 Drawing Sheets

(56) References Cited

U.S. PATENT DOCUMENTS

| | | | | |
|---|---|---|---|---|
| 6,757,952 | B1 * | 7/2004 | Stager | B27L 11/005 144/174 |
| 6,915,971 | B2 | 7/2005 | Pallmann | |
| 7,377,298 | B2 | 5/2008 | Pallmann | |
| 7,708,039 | B2 * | 5/2010 | Pallmann | B27L 11/005 144/162.1 |
| 2002/0170992 | A1 * | 11/2002 | Pallmann | B02C 18/186 241/91 |
| 2003/0042346 | A1 * | 3/2003 | Pallmann | B02C 18/06 241/294 |
| 2006/0208118 | A1 | 9/2006 | Holzer et al. | |

FOREIGN PATENT DOCUMENTS

| | | | |
|---|---|---|---|
| DE | 20 2005 001 170 | U1 | 5/2005 |
| DE | 10 2004 004 877 | A1 | 8/2005 |
| EP | 0 775 043 | B1 | 4/1998 |

* cited by examiner

COMMINUTING UNIT FOR A COMMINUTING DEVICE FOR COMMINUTING FEED MATERIAL, IN PARTICULAR KNIFE BASKET

This nonprovisional application claims priority under 35 U.S.C. § 119(a) to German Patent Application No. 10 2015 005 787.1, which was filed in Germany on May 9, 2015, and which is herein incorporated by reference.

BACKGROUND OF THE INVENTION

Field of the Invention

The invention relates to a comminuting unit for a comminuting device for comminuting feed material.

Description of the Background Art

Such comminuting units are, for example, used in knife ring flakers with a fixed or rotating knife ring, where they serve especially for comminuting wood, which is fed as lumpy material in the form of logs or as pourable material in the form of chips. The chips thus produced serve among other things as a starting material for the production of OSB products or for the chipboard industry.

Thus, from DE 101 25 922 A1, DE 10 2004 004 877 A1 and EP 0 775 043 B1, knife ring flakers are known, which have a knife ring freely rotating about an axis serving as a comminuting unit, the knife ring substantially composed of two concentric support disks, which are connected to each other via blade supports arranged in a ring. The inner peripheral surface of the knife ring is thus formed by the undersides of the blade supports and at the same time represents the boundary for the comminuting chamber. Due to the high mechanical stresses, this area is designed wear-resistant.

The individual blade supports are mutually arranged at a predetermined distance so that they form longitudinal gaps over the axial dimension of the inner circumferential surface of the knife ring. In this area, the blade supports have recesses for receiving knife assemblies. Each knife assembly has a chipping blade and a blade holding plate, which are adjustable via long holes and screws and are detachably connected with each other. When installed, the chipping blades of the knife assemblies extend through the released longitudinal gaps between the blade supports over the inner circumferential surface into the comminuting chamber. The blade supernatant thereby determines the thickness of the chips to be produced. In this way, together with the cutting edges of the chipping blade, the peripheral surface of the knife ring forms the grinding surface of a knife ring flaker.

A prerequisite for high-quality comminution of the feed is that all blades of a knife ring are arranged on a common cutting circle with an identical blade projection. To ensure this, each blade support has a fixedly defined stop which defines the so-called zero position of the knife assemblies. A preset knife assembly is installed to bear at the stop, so that in this way the desired blade supernatant naturally results.

During operation, a knife ring flaker is subjected to natural wear. In particular, the inner circumferential surface of the knife ring, including the blade holding plates and chipping blades, are affected to a great extent. Due to different material properties, assembly and function in the comminuting chamber as well as duration of use, the named parts exhibit varying degrees of wear. The associated change in the geometric conditions in the machine-cutting region affects the chip quality, so that by exceeding predetermined tolerances, the knife assemblies must be swapped and or the components forming the peripheral surface of the comminuting chamber must be sharpened or replaced. The downtime caused thereby essentially determines the economic operation of such devices.

SUMMARY OF THE INVENTION

It is therefore an object of the present invention to provide a comminuting unit for comminution devices, ensuring high chip quality and at the same time, cost-effective operation.

In an embodiment of the invention, the essential parts of the receiving area of a knife assembly are configured as separate parts that are detachable from the blade support, which allows for a targeted replacement of parts, dependent on the state of wear. In this case, the clamping strip takes on a double function: on the one hand tensioning a knife assembly against the receiving strip, but at the same time also forming the wear protection for the blade support. This has the advantage that the clamping strip, which when replacing the knife assemblies must be released either way, can also be replaced within this context, if required, resulting in synergy effects.

A receptacle structured in several detachable parts, however, results in that the dimensional tolerances of the individual parts add up and in their sum change the geometry of the receptacle. In combination with an adjusting device for adjusting the blade supernatant, such tolerances can be compensated, which if needed are entered in the blade support when replacing the parts. Thus, high chip quality is always guaranteed.

Advantageously, the adjusting device is disposed on the receiving strip so that it may be disassembled, checked, and, if necessary, replaced, along with the receiving strip.

To adjust the cutting board, the adjusting device preferably has a stop block as an abutment surface, whose distance from the receiving strip is adjustable by interposed spacer plates. This embodiment has proven to be extremely robust and allows for a very fine adjustment of the cutting board.

In an embodiment of the invention, the base body of the blade support and the receiving strip have cooperating interlocks in the common contact joint. In this way, shearing forces in the contact joint are extensively eroded over the surfaces involved in the positive engagement, and as a result, an overstressing of the material is avoided. In addition, the interlocks guarantee an exact fit of the receiving strip on the base body, and thus the adherence to a precise cutting geometry.

Also, in an embodiment of the invention, the receiving strip can have a substantially U-shaped cross section, i.e. a cross-section with a web and two legs molded thereto. This cross sectional shape provides between the legs a space for accommodating a knife assembly, wherein the adjustment device may be integrated in the web region. This results in a very compact structure of the blade support.

In an embodiment, the two free ends of the legs form axially extending bearing surfaces, which cause a statically defined bearing of the clamping strip or the knife assembly, resulting in a unique power flow through the blade support. This allows for a precise determination of the loads applied on the individual parts.

The clamping strip may have a recess for receiving the free end of the rear leg in a form-fitting manner during assembly of the blade support. The positive fit ensures a precise fit of the clamping strip and thus of the knife assembly within the blade support.

In order to clamp the knife assemblies, clamps are provided which press the clamping strip against the receiving strip. The clamps can be arranged such in the blade supports, that the anchors of the clamp rest on the back side of the blade supports which are facing counter the direction of rotation. This first has the advantage that the flow of material directed outwardly along the front side of the blade support is not obstructed by the anchors of the clamps. Simultaneously, the inventive clamping direction promotes an applied force as uniformly as possible onto the receiving strip and a secure fit of the clamping strip on the receiving strip. It has been proven advantageous in this context when the clamping direction predetermined by the clamp forms an angle $\alpha$ of at least 120°, preferably of least 130°, most preferably of least 140°, with the plane of the chipping blade.

In order to increase the moment of inertia and thus the bending stiffness of the blade support in its longitudinal direction, an advantageous embodiment of the blade support has a cross-section divided in the radial direction, having an inner, a middle and an outer region, wherein the inner and the outer region have a larger cross-sectional width as compared to the middle region.

The broadening in the outer area may only be present on the back side of the base body in order to ensure a mostly unhindered chip removal at the front side of the blade support.

It is advantageous if the blade support has front end connection plates which during securing of the blade support bear flat against the support ring of a knife basket. This results in a particularly low-deformation adjacent construction.

If a centering is provided in the connecting surface between the blade supports and the support ring, these can increase the positional accuracy of the blade supports within the knife basket.

In accordance with an embodiment of the invention, the clamping plate arranged between the chipping blade and the receiving strip can be fixedly connected with the knife assembly so that when a knife assembly is replaced, the clamping strip is also replaced without any further action.

Alternatively, the clamp plate may also be rigidly connected to the receiving strip, which is particularly advantageous when only the blade holding plate and the chipping blade need to be changed together, and the clamping plate is replaced at longer intervals.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
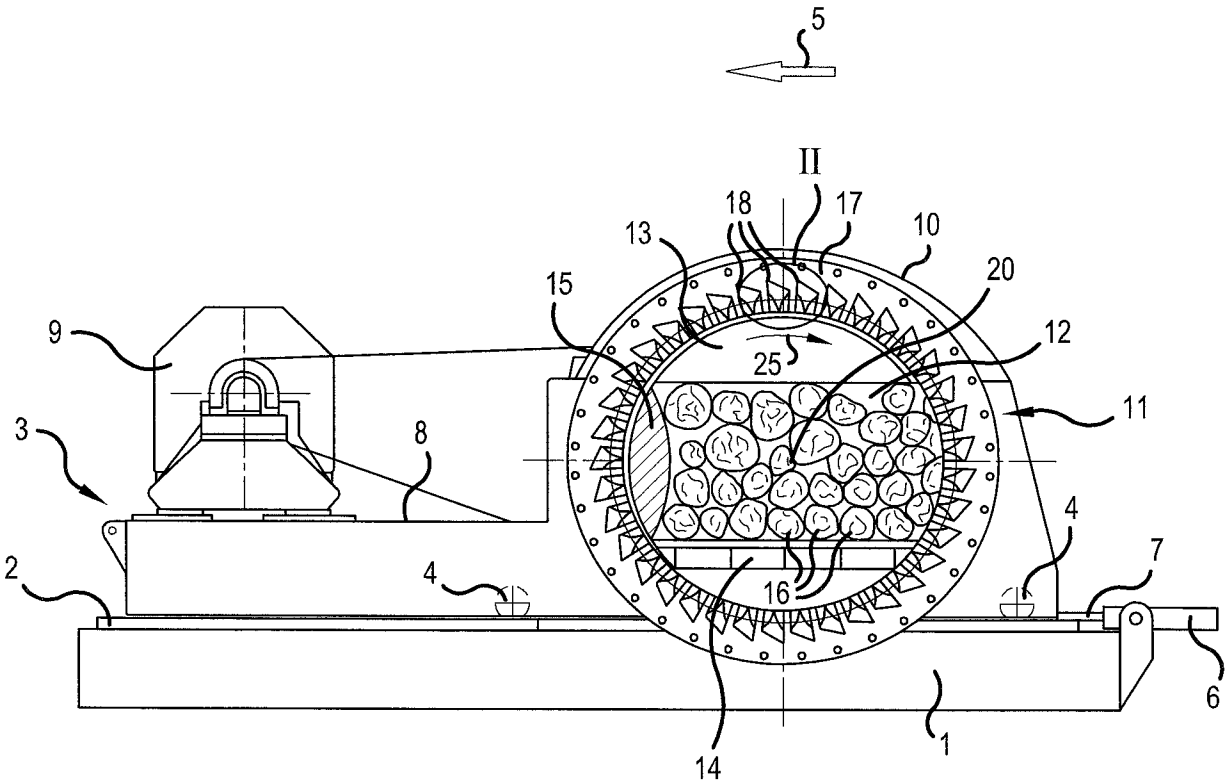
FIG. 1 a longitudinal section through a long log flaker with a rotating knife basket, FIG. 2 a partial section through region II illustrated in FIG. 1, on a larger scale, FIG. 3 a section through the knife basket shown in FIG. 2, along line III-III shown there, FIG. 4 a detail of area IV illustrated in FIG. 2, and FIG. 5 a detail of a further embodiment of the region illustrated in FIG. IV.

FIG. 1 illustrates a vertically guided longitudinal section through a long log flaker. One first sees a stationary base 1, at which upper side rails 2 are arranged which extend on display level. The rails 2 serve as a track for a machine base frame 3, which is transversely displaceably arranged on the wheels 4 in the direction of the arrow 5. A cylinder-piston unit 6, whose movable piston 7 acts on the machine base frame 3 and so provides the transverse movement of the machine base frame 3, is fixedly connected to the base 1. The machine base frame 3 also has a platform 8, which supports an electric motor 9.

Further, a dome-shaped housing 10 is secured to the machine base frame 3, which serves for the reception of a knife basket 11 that is freely rotatable about a horizontal axis 20. While the rear wall of the housing 10 is closed and is used to mount the drive shaft of the knife basket 11, the front face of the housing 10 has a circular opening through which a comminuting chamber 12 enclosed by the housing 10 is freely accessible. The comminuting chamber 12 is bounded above by a circular arc segment 13 whose curved side extends at a short distance to the knife basket. In the lower region, a smoothed-out floor structure 14 delimits the comminuting chamber 12, which like the circular arc segment 13 is fixedly connected to the housing 10. The boundary surface of the comminuting chamber 12 situated left in the display plane is formed by a counter-surface 15, convex in the cross-section, axially projecting into the comminuting chamber 12, which is arranged stationary relative to the machine base 1 and thus does not follow the lateral movement of the machine base frame 3. The opposite side of the comminuting chamber 12 is ultimately formed by the inside of the knife basket 11 and simultaneously represents the comminuting track.

The feed material in the form of logs 16, like the counter bearing surface 15 axially projects with the free part of its length into the comminuting chamber 12. The part of the trunks 16 outside of the comminuting chamber 12 is located in a non-illustrated supply device, at which end it is firmly clamped for the machining process. In addition, not-illustrated depressors are provided in the comminuting chamber 12, which hold the logs 16 in the comminuting chamber 12 during the machining process.

The comminution of the logs 16 is carried out by a transverse movement of the machine base frame 3 while the knife basket 11 is rotating, wherein due to the stationary counter-surface 15, the logs 16 are pressed against the grinding surface and are put on engagement with the grinding tools.

Figure 2:
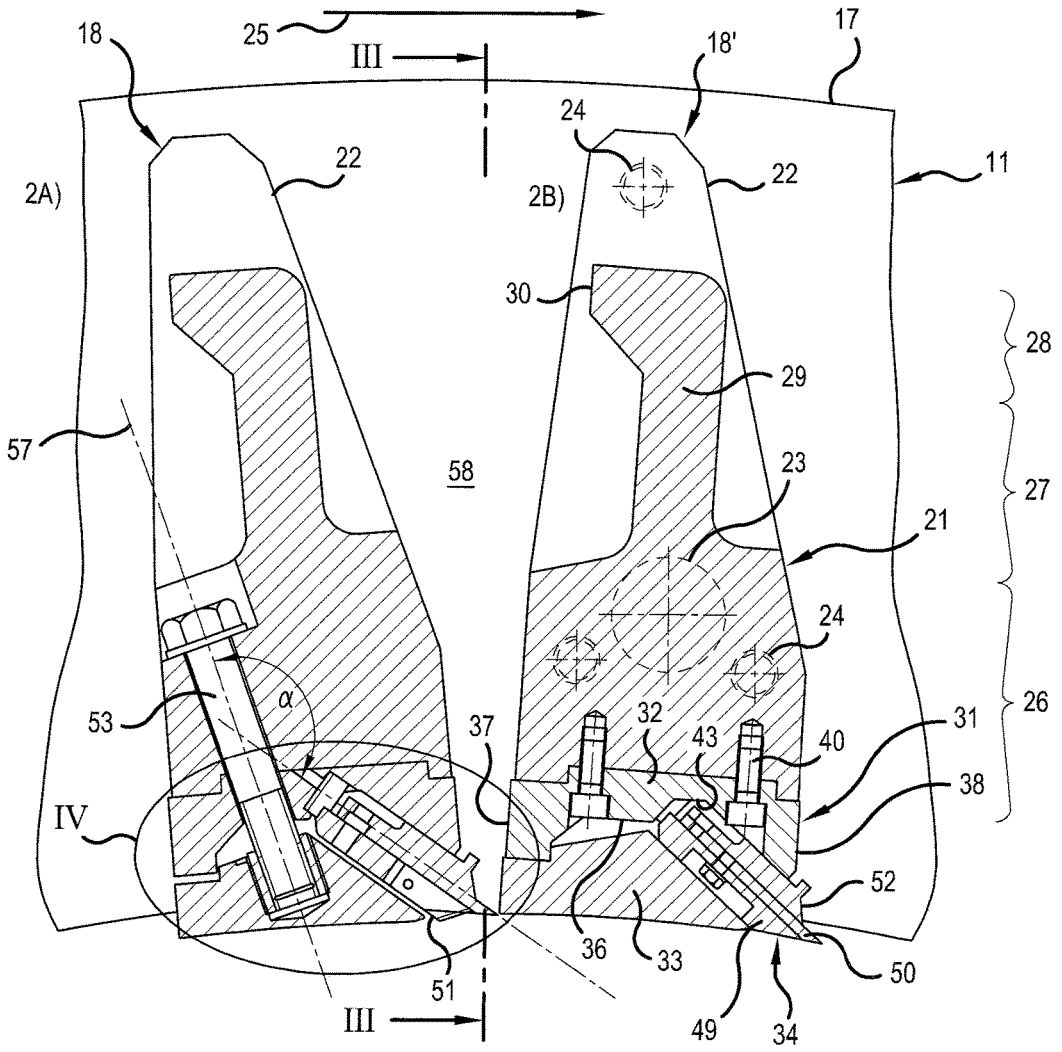
Figure 3:
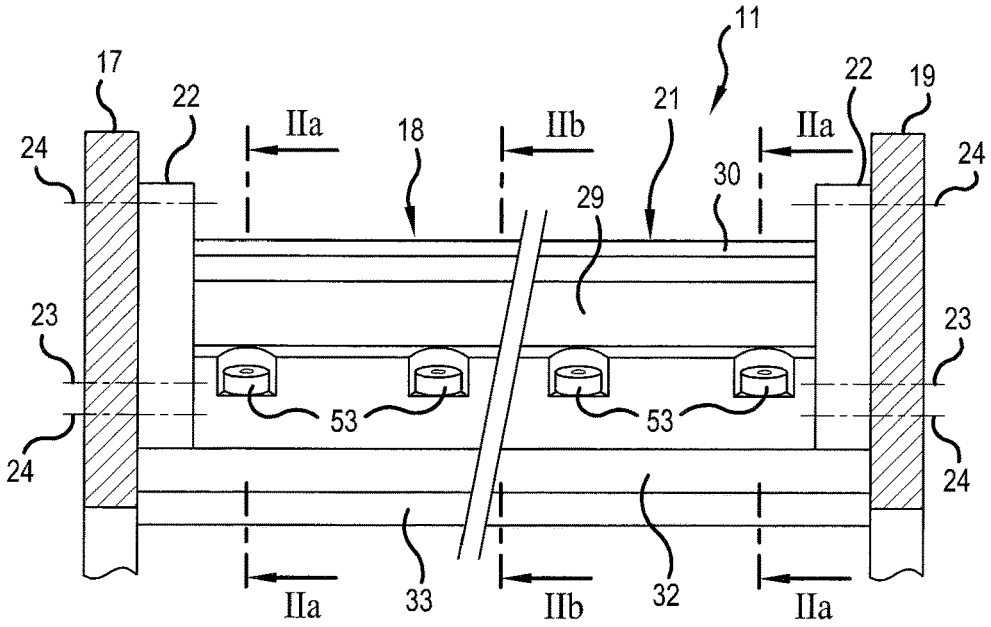
Figure 4:
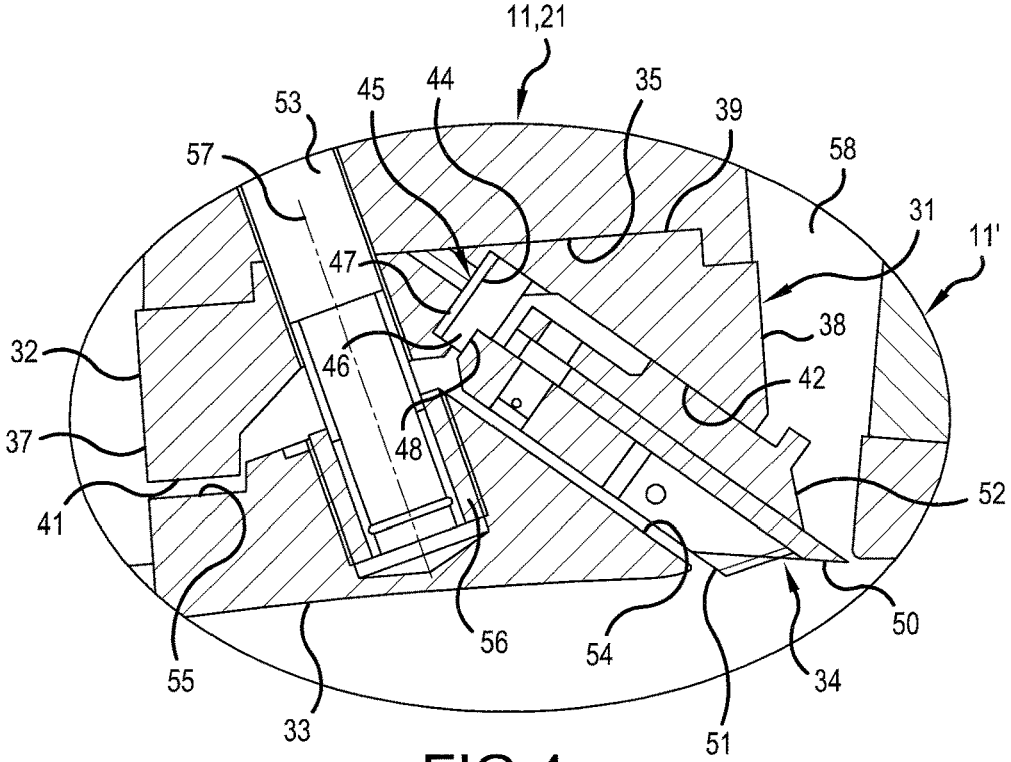

As can be seen above all from a comparison of FIGS. 2, 3 and 4, the knife basket 11 has two concentric and mutually spaced support disks 17, 19 of which because of the cutting guide only the rear support disk 17 can be seen in FIG. 1 and in FIG. 2. The insides of the two annular disks 17, 19 are connected by axially aligned blade supports 18 which are distributed uniformly over the periphery, creating an inherently stiff knife basket 11. The direction in which the knife basket 11 rotates around the axis 20 during the comminuting operation is indicated by the arrow 25.

The precise arrangement of the blade supports 18 among each other and with respect to the annular disks 17 and the detailed structure of the blade supports 18 are shown in particular in FIGS. 2 and 3, wherein the cutting plane of the blade support 18 illustrated on the right in FIG. 2 is indicated by the intersecting line IIa-IIa in FIG. 3, and the cutting plane of the blade support 18 shown on the left is indicated by the intersecting line IIb-IIb.

Each blade support 18, 18' essentially has a solid rod-shaped base body 21, which at both ends respectively has a connecting plate 22 extending perpendicular to the blade support axis. The connecting plates 22 can thereby radially project outwardly beyond the base body 21, thus having a greater radial height. Preferably, the base body 21 and the connecting plates 22 are screwed together or welded out of a cast or in the butt joint. The connecting plates 22 have a flat connecting surface facing the respective support ring 17, 19, with which they rest against the inside of a support ring 17, 19. In the contact area, a centering 23 and fasteners 24 are arranged, which by interacting ensure a secure connection in exact position. The centering 23 includes, for example, fitting bolts or washers that are inserted in corresponding fitting holes in the connecting surfaces. The fasteners 24 are preferably formed by screws. In FIG. 2, the centering 23 and the fasteners 24 are merely indicated by their dash-dotted axes.

In the radial direction, relative to the axis 20, the base body 21 is subdivided into a radial inner region 26 of maximum width in the circumferential direction, a middle region 27 which begins approximately halfway up the main body 21, where the base body 21 is formed as a relatively narrow radial web 29, and a radial outer portion 28, which has a widened head 27 that sits opposite the middle portion. In the present embodiment, the widening is unilaterally formed by a lug 30 on the back side of the blade support 18 that faces the direction of rotation 25 and extends over the entire axial length of the base body 21. The front side of the blade support 18 and the back side of a leading blade support 18' thereby form a chip removal channel 58, through which the chips are radially carried outward, collected there and conducted out of the chipper. The closed smooth surface of the front side of the base body 21 thereby favors an unhindered chip removal.

As shown especially in FIGS. 2 and 4, disposed on the bottom of the blade support 18, 18' facing the axis 20 is a receptacle 31 with a receiving strip 32 and a clamping strip 33, between which a knife assembly 34 is interchangeably held at a predetermined rake angle and a predetermined blade projection. For the exact positional centering of the receptacle 31, the underside of the blade support 18, 18' facing the axis 20 is formed as a bearing surface, with a form-locking groove 35 extending over the entire length of the blade support 18, 18'. The bearing surface is used to connect the receiving strip 32, which along its length has a substantially U-shaped cross section with a central web 36, and a rear leg 37 and a front leg 38 that are relative to the rotational direction 25.

The outer side of the web 36 facing away from the legs 37, 38 represents the counter-bearing surface and to this end over the entire length of the receiving strip 32, has a form-locking strip 39 complementary to the form-locking groove 35, which serves both for the exact centering of the receiving strip 32 relative to the remaining blade support 18 and also for the transmission of power. With the help of the screws 40, the receiving strip 32 is clamped against the bearing surface of the blade support 18, 18'.

The rear leg 37 seen in the rotation direction 25 has, with respect to the cross section, a constant width in the region of the free end facing the axis 20, whereby there, a lug 41 with a rectangular cross section and an axially extending bearing surface are formed, while the width of the rear leg 37 steadily increases towards the web 36. With its inner side facing the rear leg 37, the front leg 38 on the other hand forms a plane surface 42, which inclination determines the rake angle.

The web 36 of the receiving strip 32 has on the inside facing the axis 20 a recess 43 extending over the axial length and having a trapezoidal cross-section, wherein the front side in the rotational direction 25 of the recess 43 merges flush with the plane surface 42, and in the region of the other side of the recess 43, in each case in the end region of the receiving strip 32, a local blind hole-like recess 44 is arranged, in which an adjusting device 45 for adjusting the blade supernatant is inserted.

The adjusting device 45 comprises a block 46, which is inserted into the recess 44 with play and with the interposition of a predetermined number of spacer plates 47, and which is tensioned by a screw against the base of the recess 44. The opposite side of the block 46 has a stepped design with a deeper stop surface 48, which is intended to bear the knife assembly 34.

Such a knife assembly 34 essentially has a blade holding plate 49 with a slot and a chipping blade 50 resting thereon, which are interconnected by screws in a known manner, wherein the total width of the knife assembly 34 has been adjusted within a gage outside the knife basket to the required value that is necessary for the desired blade supernatant. On the side opposite the blade-holding plate 49, a clamping plate 52 with a molded chip breaker bar is situated on the chipping blade 50, which can also be bolted to the knife assembly 34. In addition, scribers 51 are integrated in the blade holding plate 49 for cutting the manufactured chips.

In the course of striking the knife assembly 34 on the stop surface 48 preset by the appropriate choice of the number of spacer plates 47, and by engagement of the clamping plate 52 on the plane surface 42 of the receiving strip 32, the required blade supernatant results in of itself.

To fix the knife assembly 34, the clamping strip 33 is clamped against the receiving strip 32 by clamping screws 53. For this purpose, the clamping strip 33 has a flat surface 54 which runs parallel to the plane surface 42 on the receiving strip 32 and which can be brought in contact with the blade holding plate 49 for the clamping operation. Along the rear longitudinal edge, the clamping strip 33 has a recess 55 continuous in the axial direction, which corresponds in size roughly to the lug 41. In the middle region, with respect to the cross section of the clamping strip 33, holes spaced over the length of the clamping strip 33 are disposed, in which threaded inserts 56 are anchored, in which the clamping screws 53 engage with their threaded portion.

The clamping direction 57 predetermined by the longitudinal axis of the clamping screws 53 is inclined opposite the plane of the chipping blades 50 at an angle $\alpha$, whereby the angle $\alpha$ is at least 120°, preferably at least 130°. In the present embodiment, the angle $\alpha$ is between 140° and 150°. The clamping screw 53 thereby protrudes through the back side of the blade support 18 and is supported there on the base body 21, with its head in the transition region between the inner region 26 and the middle region 27. When clamping the screws 53, the lug 41 forms a toothing at the rear leg 37 of the receiving strip 32 with the recess 55 of the clamping strip 33, while the knife assembly 34 is pressed against the receiving strip 32 by the flat surface 54 of the clamping strip 33.

Figure 5:
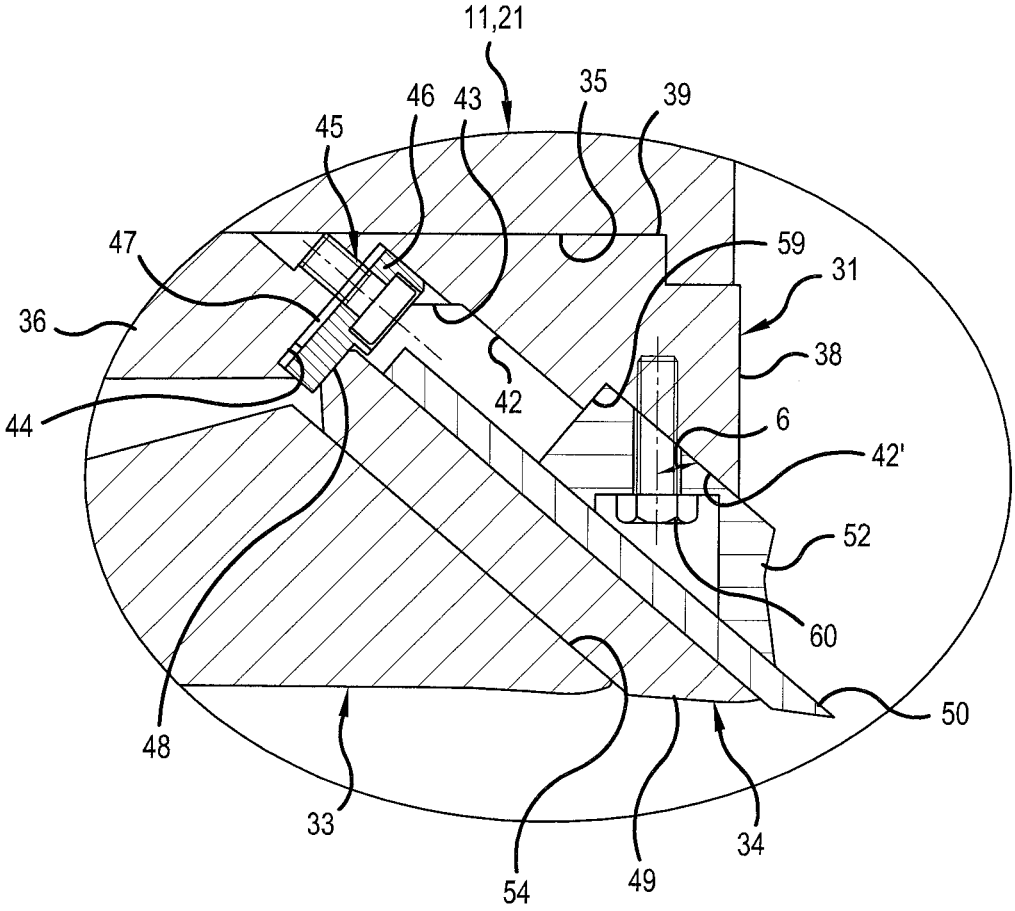

FIG. 5 shows another embodiment of the area marked in FIG. 2 with IV which largely corresponds to the blade support 18 described in FIGS. 1 to 4, so that the numerals used there and what was said apply accordingly. Differences to the above embodiment mainly exist especially in the area of the clamping of the knife assembly 34 against the receiving strip 32.

In the embodiment shown in FIG. 5, the plane surface 42 of the receiving strip 32 is formed in a stepped manner, wherein the recessed plane-parallel partial surface 42' extends along the front side of the blade support 18 over the entire length of the blade support 18. The transition from the plane surface 42 to the flat partial surface 42' is defined by a lug 59 extending perpendicular to the surfaces 42, 42'. The partial surface 42' and the lug 59 in this way form a receptacle in which the clamping plate 52 is arranged in a form-fitting manner. In order to fix the clamping plate 52 in the receptacle, a plurality of screws 60 are provided over the length of the clamping plate 52, which tension the clamping plate 52 against the partial surface 42'. The tightening direction of the screws 60 thereby forms an angle δ with the partial surface 42' that corresponds approximately to 90° minus the rake angle. Preferably, the angle δ is less than 90° and is for example between 40° and 50°, whereby it is achieved that the clamping plate 52 is also clamped against the lug 59, which sets the correct target position of the clamping plate 52 relative to the receiving strip 32.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A comminuting unit for a comminuting device for the comminution of feed material, the comminuting unit comprising:

at least two rod-shaped blade supports that are concentrically arranged about an axis, each of the at least two rod-shaped blade supports being rigidly connected at their ends to a support ring or a supporting disc concentric to the axis, each of the at least two rod-shaped blade supports having a receptacle for securing a knife assembly having a comminuting blade;

the receptacle having a receiving strip and a clamping strip arranged therein, the receiving strip and the clamping strip each being mounted in an axially parallel position releasably to a respective one of the at least two rod-shaped blade supports, wherein the knife assembly is clamped against the receiving strip by the clamping strip, and wherein the blades of all comminuting blades are at a common radial distance from the axis;

wherein the clamping strip is tensioned against the at least two rod-shaped blade supports by a clamp and by clamping the knife assembly, wherein the straight line in a radial plane of the at least two rod-shaped blade supports defined by the clamping direction of the clamp is inclined such that the course of the straight line emerges radially outwardly from the rear side of the at least two rod-shaped blade supports.

2. The comminuting unit according to claim 1, further comprising at least one adjusting device provided between each of the at least two rod-shaped blade supports and the knife assembly, via the at least one adjusting device a radial distance is adjustable, wherein the at least one adjusting device is disposed on the receiving strip and has a stop surface that is adjustable, the stop surface cooperating with a longitudinal side of the knife assembly.

3. The comminuting unit according to claim 2, wherein the stop surface of the at least one adjusting device is formed by a stop block, which with the interposition of spacer plates is tensioned against the receiving strip.

4. The comminuting unit according to claim 1, wherein each of the at least two rod-shaped blade supports comprises a base body, of which an underside facing the axis forms a bearing surface for the receiving strip, wherein the receiving strip has a counter bearing surface facing away from the axis, wherein the bearing surface and the counter bearing surface define a common contact surface between the base body and the receiving strip, wherein a first interlock is arranged on the bearing surface, the interlock cooperating with a complementary second interlock on the counter bearing surface, wherein the first interlock is a groove in the bearing surface and the complementary second interlock is a protrusion that protrudes from the counter bearing surface, the protrusion being inserted into the groove, and wherein the receiving strip further includes screws that clamp the receiving strip to the base body.

5. The comminuting unit according to claim 1, wherein the receiving strip has a U-shaped cross section, with a front leg in a rotational direction and a rear leg in the rotational direction, where both the front leg and the rear leg point towards the axis, and with a web connecting the front leg and the rear leg, and wherein, on the web, the at least one adjusting device is arranged.

6. The comminuting unit according to claim 5, wherein the rear leg forms an axially extending bearing surface for the clamping strip and the front leg forms an axially extending clamping surface for the knife assembly.

7. The comminuting unit according to claim 6, wherein the clamping strip has a recess in a region facing the axially extending bearing surface of the rear leg of the receiving strip, such that the rear leg of the receiving strip engages the recess.

8. The comminuting unit according to claim 1, wherein the clamping strip is tensioned against the at least two rod-shaped blade supports by the clamp and by clamping the knife assembly, wherein the straight line defined by the clamping direction of the clamp relative to the plane of the chipping blade has an angle α of at least 120°.

9. The comminuting unit according to claim 1, wherein the base body of each of the at least two rod-shaped blade supports is divided in the radial direction from the inside to the outside with respect to the axis into an inner region, an adjoining middle region, and a thereto adjoining outer region, wherein the width of the base body transverse to the longitudinal extension direction in the middle region, relative to a width in the inner region, is reduced, and a width in the outer region, relative to the width in the middle region is increased.

10. The comminuting unit according to claim 1, wherein the base body of each of the at least two rod-shaped blade supports in the radial direction from the inside to the outside is divided with respect to the axis into an inner region, an adjoining middle region and a thereto adjoining outer region, wherein the outer region has an axially extending lug only on a rear side of the outer region.

11. The comminuting unit according to claim 1, wherein each of the at least two rod-shaped blade supports, at each of two end sides, has a connecting plate with a connecting surface on the support ring.

12. The comminuting unit according to claim 11, wherein, between each of the at least two rod-shaped blade supports and the support ring, a centering is arranged.

13. The comminuting unit according to claim 1, wherein the clamping strip is rigidly connected with the knife assembly.

14. The comminuting unit according to claim 1, wherein the clamping strip is rigidly connected with the receiving strip.

* * * * *